United States Patent [19]

Arnau Pibet

[11] 4,184,285

[45] Jan. 22, 1980

[54] SHIPBUILDING TOY

[75] Inventor: Jose M. Arnau Pibet, Barcelona, Spain

[73] Assignee: Exin-Iber S. A., Barcelona, Spain

[21] Appl. No.: 845,842

[22] Filed: Oct. 26, 1977

[30] Foreign Application Priority Data

Dec. 7, 1976 [ES] Spain ..... 224.971[U]

[51] Int. Cl.[2] ..... A63H 33/08

[52] U.S. Cl. ..... 46/24; 46/93

[58] Field of Search ..... 46/17, 24, 25, 93

[56] References Cited

U.S. PATENT DOCUMENTS

| | | | |
|---|---|---|---|
| 2,398,223 | 4/1946 | Gilbert | 46/17 |
| 2,910,737 | 11/1959 | MacMillan | 46/24 |
| 3,481,068 | 12/1968 | Paulson | 46/25 |

FOREIGN PATENT DOCUMENTS 419311 10/1934 United Kingdom .

*Primary Examiner*—Louis G. Mancene
*Assistant Examiner*—Robert F. Cutting
*Attorney, Agent, or Firm*—Cushman, Darby & Cushman

[57] ABSTRACT

A toy block shipbuilding kit, with specially formed pieces to provide realistic ships stems and sterns. A number of first blocks are provided with curved sides, and interlocking projections and projection-receiving portions formed on the top and bottom faces. When stacked upon each other, the blocks are staggered and form a continuous upwardly sloping stem or stern portion, and can interlock with other conventional parallelepiped blocks to form the ship body. Specialty second blocks are provided for forming the top or bottom terminations of stacked first blocks, and specialty third blocks may be provided having sides extending above the top faces thereof to constitute side rails for a ship's stem and stern.

14 Claims, 5 Drawing Figures

SHIPBUILDING TOY

BACKGROUND AND SUMMARY OF THE INVENTION

The invention relates to a toy block shipbuilding kit, and particular toy blocks forming the kit, which is highly suitable for children since it is possible to construct structures resembling actual ships including properly formed stems and sterns. Heretofore it has not been possible to construct ships from toy block kits having realistic stems and sterns because only parallelepiped blocks were employed which provided corners rather than realistic stems and sterns. Ships built with current toy block kits do not represent the real appearance of ships, but have only a remote resemblance to actual ships.

According to the present invention, a plurality of toy blocks are provided that are specially adapted for forming the ship's stem and stern. Each block of a first set of blocks includes a generally planar bottom face, a generally planar top face, symmetrically spaced projections extending upwardly from the plane of the top face, projection receiving means associated with the bottom face for receiving symmetrically spaced projections like those on the top face for interlocking engagement, and first and second side faces. Each of the side faces has curved portions converging toward the other and adjoining the other at tip portions including tip portions disposed in the planes of the top and bottom faces. At least a third side face is also provided, disposed in a plane generally perpendicular to the top and bottom faces, and the tip portion in the plane of the top face is spaced further from the third face than is the tip portion in the plane of the bottom face, so that a number of such blocks stacked upon each other provide an upwardly sloping surface from bottom to top, resembling the actual configuration of a real ship stem or stern. The height of the side faces are substantially the same as the distance between the top and bottom faces for the first set of blocks.

A second set of blocks also may be provided, each block of the second set having generally planar top and bottom faces, and first and second side faces, each having curved portions converging toward the other and adjoining the other at a tip portion in the same manner as the curvature of the first and second side faces of the first blocks. However, the second blocks are relatively thin, and the first and second side faces are generally perpendicular to the top and bottom faces. Projections on the top face are positioned with respect to the top face so that when the first and second side faces of a second block coincide with the first and second side faces of the first block along the first block bottom face, the projections on the second block top face are received in interlocking engagement by the projection receiving means associated with the first block bottom face.

The third set of blocks also is preferably provided for forming top rail portions for either the stem or stern. Each block of the third block set includes generally planar top and bottom faces, and first and second side faces each having curved portions converging toward the other and adjoining the other at a tip portion, the curvature being substantially the same as for the first blocks and first and second side faces. The first and second side faces of the third blocks extend from the bottom face in a direction perpendicular to the bottom face a distance greater than the distance the top face is spaced from the bottom face, so that side rails are provided. Projection receiving means are associated with the bottom face of each third block, and located with respect to the bottom face so that when the first and second side faces of the third block are disposed coinciding with the first and second faces of a first block along the first block top face, the projection receiving means receive the projections on the first block top face in interlocking engagement.

The tip portions of some of the first, second and third blocks can form a point for the construction of the ship stern, and the tip portions of at least some of the other first, second and third blocks can form a continuous curved surface with the first and second faces for the construction of a realistic ship stern.

While any suitable projection and projection receiving means can be provided that provide for interlocking of the component parts, it is preferred that the projections and projection receiving means have the construction provided in U.S. Pat. No. 3,716,939 (the disclosure of which is hereby incorporated by reference in the present application). The projections on each first block top face are disposed with respect to the projection receiving means on the bottom face so that one of the first blocks may be stacked upon another of the first blocks in interlocking engagement, with the first and second side of the blocks providing a continuous smooth contour, and with at least some of the projections on the top face of the lower most block—adjacent the third face thereof—not being received by the projection receiving means of the upper block. Such projections are then connectable up to conventional parallelepiped blocks in toy block kits, such as particular shown in U.S. Pat. No. 3,716,939.

It is the primary object of the present invention to provide a toy block shipbuilding kit, with specialty blocks therein, for the construction of realistically contoured toy ships. This and other objects of the invention will become clear from an inspection of the detailed description of the invention, and from the appended claims.

DETAILED DESCRIPTION OF THE INVENTION

Figure 5:
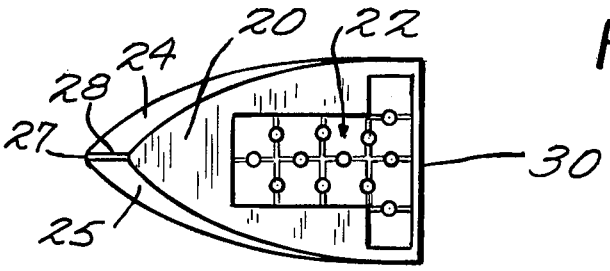
FIG. 5 is a bottom plane view of a stern first block according to the invention showing exemplary projection receiving means associated with the bottom face thereof.

The shipbuilding kit according to the present invention comprises several main pieces—first blocks—for the construction of a ship's stem and stern. First block stem pieces are shown generally at 1 in the drawings, and first block stern pieces are shown generally at 2. Each of the first blocks 1, 2 comprises a generally planar bottom face 20, a generally planar top face 21, and symmetrically spaced projections 3 extending upwardly from the plane of the top face 21. The projections 3 may be any suitable conventional projections for providing interlocking between blocks, such as shown in U.S. Pat. No. 3,716,939 (the disclosure of which is hereby incorporated by reference in the present Application). Projection receiving means 22 (see FIG. 5) are associated with the bottom face for receiving symmetrically spaced projections like those on the top face 21 for interlocking engagement therewith. The projection receiving means 22 also are preferably those of U.S. Pat. No. 3,716,939 although other projection receiving means may be suitable.

Figure 1:
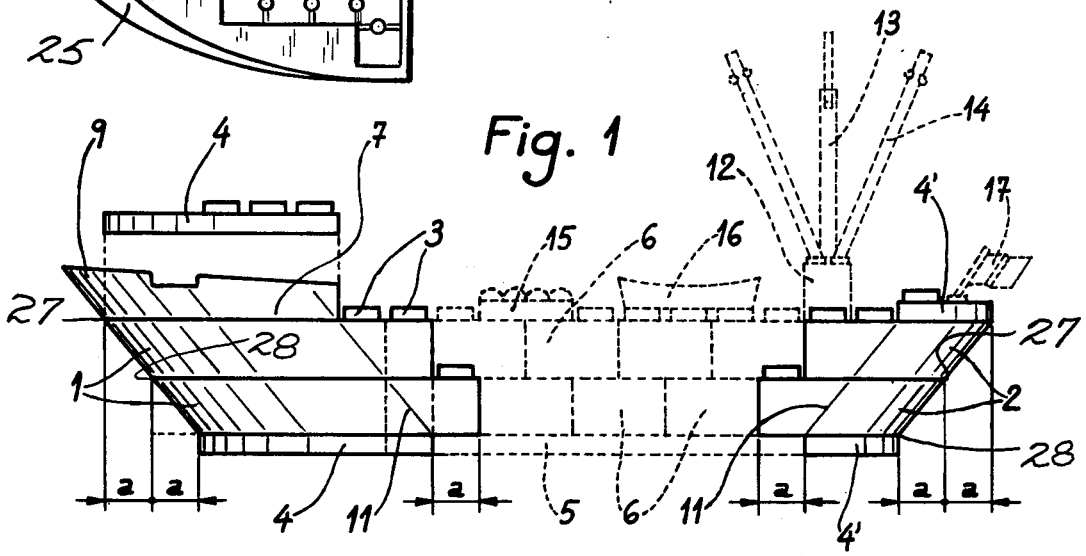
FIG. 1 is a side view showing exemplary ship stem and stern portions that can be constructed utilizing the shipbuilding kit according to the present invention, with conventional parallelepiped blocks shown in dotted line interconnecting the stem and stern portions.
Figure 2:
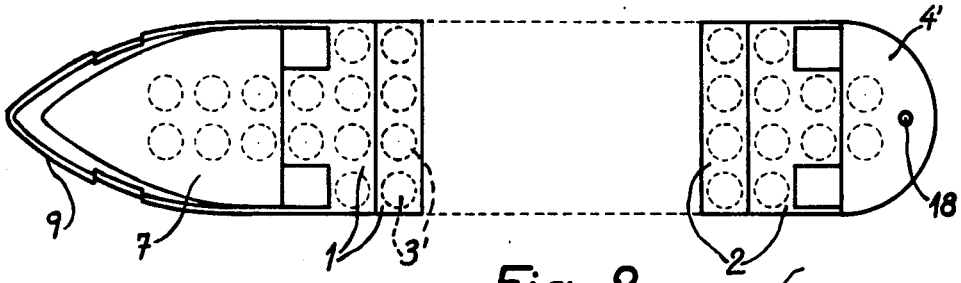
FIG. 2 is a top view of the ship of FIG. 1, with the parallelepiped connecting blocks removed for clarity.
Figure 3:
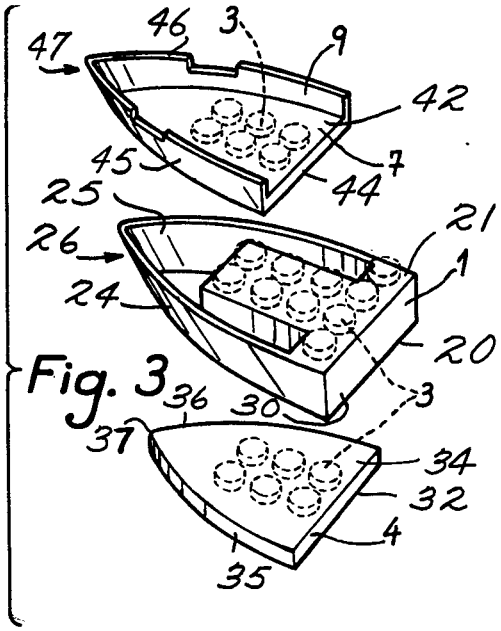
FIGS. 3 and 4 are perspective views of first, second and third blocks according to the invention for the construction of a ship's stem and stern respectively.
Figure 4:
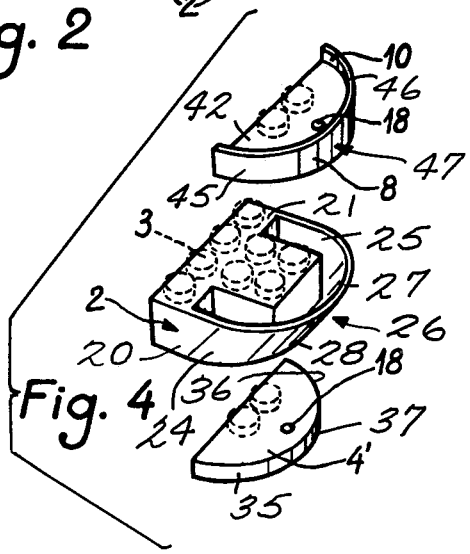

Each of the first blocks 1, 2 also includes first and second side faces 24, 25 respectively each having curved portions converging toward the other and adjoining the other at tip portions 26, including tip portions 27, 28 disposed in the planes of the top and bottom faces 21, 20 respectively. At least a third side face 30 is also provided, disposed in a plane generally perpendicular to the top and bottom faces 20, 21. The tip portion 27 in the plane of the top face is spaced further from the third face 30 then is the tip portion 28 in the plane of the bottom face 20, so that—in side view (FIG. 1)—they are horizontally spaced a distance "a." As is readily apparent from the drawings, the projections 3 are disposed on the top face 21 with respect to the projection receiving means 22 on the bottom face 20 so that one of the blocks 1, 2 may be stacked upon another of the blocks 1, 2, in interlocking engagement, with the first and second sides 24, 25 of the blocks providing a continuous smooth surface, and with at least some of the projections 3 on the top face of the lower most block (see FIG. 1) adjacent the third face 30 thereof, not being received by the projection receiving means 22 of the upper block. Such projections—indicated at 3' in FIG. 2—may be interlocked with conventional parallelepiped pieces 6, such as shown in U.S. Pat. No. 3,716,939. Conventional base plates 5 also may be used to effect the interlocking, the conventional base plate 5 having projection received by the overlapping projection receiving means 22 of the blocks 1, 2 as shown in FIG. 1.

The kit also includes flatter second blocks 4, 4', also for forming a ship's stem or stern effectively. Each of the second blocks 4, 4' includes a generally planar bottom face 32, a generally planar top face 34, first and second side faces 35, 36, each having curved portions converging toward the other and adjoining the other at a tip portion 37, and the first and second side faces 35, 36 are generally perpendicular to the top and bottom faces 32, 34. A plurality of projections 3 are also formed on the top face 34 and positioned with respect to the top face 34 so that when the first and second faces of a second block 4, 4' coincide with the first and second faces 24, 25 of a first block 1, 2 respectively—along the first block bottom face 20—the projections 3 on the second block top face 34 are received in interlocking engagement by the projection receiving means 22 associated with the first block bottom face 20. The blocks 4, 4' serve as foundation pieces for the ship's stem and stern respectively. Additionally, projection receiving means such as the means 22 for blocks 1, 2—may be provided on the bottom face 35 of the blocks 4, 4' if desired so that such blocks may also be attached to the tops of the first blocks 1, 2—as shown in FIG. 1.

The kit also includes a plurality of third blocks 7, 8 adapted to form a ship's stem or stern, the blocks 7, 8 forming rails 9, 10 for the tops of the stem and stern to provide a realistic appearance. Each of the third blocks 7, 8 includes a generally planar top face 42, a generally planar bottom face 44, first and second side faces 45, 46, and each of the side faces having curved portions converging toward the other and adjoining the other at a tip portion 47. The first and second side faces 45, 46 extend from the bottom face 44 in a direction generally perpendicular to the bottom face a distance greater than the distance the top face 42 is spaced from the bottom faces 44, so that the side rails 9, 10 are provided. Projection receiving means—like the means 22—are associated with the bottom face 44 and located with respect to the bottom face so that when the first and second side faces 45, 46 of a third block 7, 8 are disposed coincident with the first and second side faces 24, 25 of a first block 1, 2 respectively—along the first block top face—the projection receiving means of the third block 7, 8 receive the projections 3 on the first block top face in interlocking engagement therewith. If desired, projections 3 may also be provided on the top face 42 of the blocks 7, 8, to provide interlocking engagement with further specialty pieces or conventional parallelepiped blocks 6.

In order that both stems and sterns can be constructed with blocks from the kit according to the invention, at least some of the first, second and third blocks (1, 4, and 7) have tip portions 26, 37, 47 thereof respectively that form a point, so that a realistic stem is provided; similarly, at least some of the other of the first, second and third blocks (2, 4' and 8) have the tip portions 26, 37, 47 thereof disposed as a continuous curved surface with the first and second faces forming the tip portions, to provide a realistic stern. Of course, the tip portions 26, 37, 47 need not necessarily be lines, but they may have a small horizontal dimension thereto. In side view, the tip portions 26 (and perhaps the tip portions 47) extend along a line that is parallel to a diagonal line 11 established by a geometric projection from a common position located on the attachment pieces.

A wide variety of combination of pieces can be utilized to construct realistic toy ships according to the invention. For instance, the base plate 5 may be used not only as supporting base pieces, but also as an upper boarder for the hull, as pieces located in mid-ship within the hull. In the latter case they would be located between additional superimposed parallelepiped blocks 6, so that a step-like effect can be obtained in the upper portion of the hull. It is also possible to establish other combinations, such as placing the second blocks 4, 4' on top of the first blocks 1, 2, etc., so as to modify the shape of the stem or the stern, etc. The kit may also include various accessory items, such as parts 12 which form a stand with openings for attachment to a mast 13; pieces 14 which form a loading runway; blocks 15 which represent a storage area or launching system for depth charges or the like; blocks 16 which represent a rescue craft or military launch and ensign piece 17, the mast of which may be fitted into a special opening 18 located in a block 4', or 8 (or in any of the other blocks); and any additional other parts desired such as those representing cannon, torpedo launchers, machine guns, and all other pertinent accessory for merchant, passenger or war ships.

It is also possible for the pieces which form the stem and the stern to have a different inclination at the rear ends then is illustrated—for instance they can form a corner or a vertically rounded end, and those ends can likewise have steps or other distinct shapes according to the shape of the various types of vessels. The pieces can be arranged in a manner other than the staggered relationship shown and in such a case, if necessary, specialty attachment pieces can be provided for connecting the stem and stern pieces to conventional parallelepiped blocks 6 or the like.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A toy block for use with other toy blocks for the construction of a toy ship, said block comprising a generally planar bottom face, a generally planar top face, symmetrically spaced projections extending upwardly from the plane of said top face, projection-receiving means associated with said bottom face for receiving symmetrically spaced projections like those on said top face for interlocking engagement therewith, a plurality of side faces consisting of first, second, and third side faces, said first and second side faces each having curved portions converging toward the other and adjoining the other at tip portions including tip portions disposed in the planes of said top and bottom faces, and said third side face disposed in a plane generally perpendicular to said top and bottom faces, said tip portion in said plane of said top face being spaced farther from said third face than is said tip portion in the plane of said bottom face.

2. A toy block as recited in claim 1 wherein the area defined by said projections on the top face is coincident with the area defined by said projection-receiving means associated with said bottom face.

3. A toy block as recited in claim 1 wherein said projections include a plurality of projections extending from said first face to said second face along a line parallel to said third face, adjacent said third face.

4. A toy block as recited in claim 3 further comprising a plurality of said projections on said top face extending in at least one row generally perpendicular to said third face, toward said top face tip portion.

5. A toy block as recited in claim 1 wherein said projections are disposed on said top face with respect to said projection-receiving means on said bottom face so that one of said blocks may be stacked upon another of said blocks, in interlocking engagement, with the first and second sides of said blocks providing a continuous smooth contour, and with at least some of said projections on the top face of the lowermost block, adjacent said third face thereof, not received by said projection-receiving means of said upper block.

6. A toy block as recited in claim 1 wherein said block side faces extend from the bottom face in a direction perpendicular to the bottom face a distance equal to the distance said top face is spaced from said bottom face, to join said top and bottom faces.

7. A toy block shipbuilding kit comprising a plurality of first blocks adapted to form a ship stem or stern, each of said first blocks comprising a generally planar bottom face, a generally planar top face, symmetrically spaced projections extending upwardly from the plane of said top face, projection receiving means associated with said bottom face for receiving symmetrically spaced projections like those on said top face for interlocking engagement therewith, first and second side faces, each having curved portions converging toward the other and adjoining the other at tip portions, including tip portions disposed in the planes of both said top and bottom faces, at least a third side face, disposed in a plane generally perpendicular to said top and bottom faces, said block side faces generally extending from said bottom face in a direction perpendicular to said bottom face a distance equal to the distance said top face is spaced from said bottom face, to join said top and bottom faces, and said tip portion in the plane of said top face being spaced further from said third face than is said tip portion in the plane of said bottom face.

8. A kit as recited in claim 7 further comprising a plurality of second blocks adapted to form a ship stem or stern, each of said second blocks comprising a generally planar bottom face, a generally planar top face, first and second side faces, each having curved portions converging toward the other and adjoining the other at a tip portion, said first and second side faces being generally perpendicular to said top and bottom faces, and a plurality of projections formed on said top face and positioned with respect to said top face so that when said first and second side faces of a second block coincide with said first and second side faces of a first block along the first block bottom face said projections of said second block top face are received in interlocking engagement by said projection-receiving means associated with the first block bottom face.

9. A kit as recited in claim 8 wherein said second blocks each include projection-receiving means associated with the bottom face thereof.

10. A kit as recited in claim 7 further comprising a plurality of third blocks adapted to form a ship stem or stern, each of said third blocks comprising a generally planar top face, a generally planar bottom face, first and second side faces, each having curved portions converging toward the other and adjoining the other at a tip portion, said first and second side faces extending from the bottom face in a direction perpendicular to said bottom face a distance greater than the distance said top face is spaced from said bottom face, and projection-receiving means associated with said bottom face and located with respect to said bottom face so that when said first and second sides faces of a third block are disposed coincident with said first and second side faces of a first block along the first block top face, said projection-receiving means receive the projections on the first block top face in interlocking engagement.

11. A kit as recited in claim 10 further comprising a plurality of projections formed on the top face of some of said third blocks.

12. A kit as recited in claim 8 wherein said tip portions of at least some of said first blocks and at least some of said second blocks form a point, and wherein said tip portions of at least some others of said first blocks at least some others of said second blocks form a continuous curved surface with said first and second faces forming said tip portions.

13. A kit as recited in claim 10 wherein said tip portions of at least some of said first blocks and at least some of said third blocks form a point, and wherein said tip portions of at least some others of said first blocks and at least some others of said third blocks form a continuous curved surface with said first and second faces forming said tip portions.

14. A kit as recited in claim 7 wherein each of said first block has a plurality of side faces consisting of said first, second, and third side faces.

* * * * *